US005877123A

United States Patent [19]

Das

[11] Patent Number: 5,877,123

[45] Date of Patent: Mar. 2, 1999

[54] HIGH TC SUPERCONDUCTING FERROELECTRIC TUNABLE FILTERS

[76] Inventor: Satyendranath Das, P.O. Box 574, Mountainview, Calif. 94042-0574

[21] Appl. No.: 840,879

[22] Filed: Apr. 17, 1997

[51] Int. Cl.[6] ..... H01P 1/203; H01B 12/02

[52] U.S. Cl. ..... 505/210; 505/700; 505/701; 505/866; 333/99.005; 333/205

[58] Field of Search ..... 333/995, 204, 333/205, 219, 235; 505/210, 700, 701, 866

[56] References Cited

U.S. PATENT DOCUMENTS 5,459,123 10/1995 Das ..... 333/995 X
5,679,624 10/1997 Das ..... 333/995 X

FOREIGN PATENT DOCUMENTS 104501 6/1983 Japan ..... 333/204
1608759 11/1990 U.S.S.R. ..... 333/204

*Primary Examiner*—Benny Lee

[57] ABSTRACT

A main CPW structure is formed by depositing two parallel films of a conductor on a film of a single crystal ferroelectric material. Cavities are formed by placing irises in a main CPW structure. These cavities are tuned to a dominant resonant frequency. By the application of a bias voltage to the main CPW structure with cavities, the permittivity of the film of the ferroelectric material, underneath the CPW structure, is changed. Thus the dominant resonant frequency of the filter is changed. By changing the level of the bias voltages, different dominant resonant frequencies of the filter are obtained. Thus a tunable band pass filter is obtained. With branch cavities on a CPW structure deposited on a ferroelectric film, a tunable band reject filter is obtained.

20 Claims, 7 Drawing Sheets

17
14
18
13
16

OUTPUT
11
14
41
13
40
VI
VI
12
C
INPUT
10

12
14
99
13
15

OUTPUT
11
14
12
43
11
11
13
42
C
L
INPUT
10

OUTPUT
11
17
14
43
XI
XI
13
42
16
C
L
INPUT
10

HIGH TC SUPERCONDUCTING FERROELECTRIC TUNABLE FILTERS

FIELD OF INVENTION

The present invention relates to filters for electromagnetic waves and more particularly, to RF filters which can be controlled electronically. Commercial YIG filters are available.

DESCRIPTION OF THE PRIOR ART

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such the device is small in size. The ferroelectrics are operated in the paraelectric phase, i.e. slightly above the Curie temperature to prevent hysteresis and a hysteresis loss with a.c. biasing field. Inherently, they have a broad bandwidth. They have no low frequency limitation as contrasted to ferrite devices. The high frequency operation is governed by the relaxation frequency, such as 95 GHz for strontium titanate, of the ferroelectric material. The loss of the ferroelectric high Tc superconductor RF tunable filters is low for ferroelectric materials, particularly single crystals, with a low loss tangent. A number of ferroelectrics are not subject to burnout. Ferroelectric tunable filters are reciprocal. Because the dielectric constant of these devices vary with a bias voltage, the impedance of these devices vary with a biasing electric field.

There are three deficiencies to the current technology : (1) The insertion loss is high as shown by Das, U.S. Pat. No. 5,451,567. (2) The properties of ferroelectrics are temperature dependent. (3) The third deficiency is the variation of the VSWR over the operating range of the time delay device.

Das used a composition of polycrystalline barium titanate, of stated Curie temperature being 20 degrees C. and of polythene powder in a cavity and observed a shift in the resonant frequency of the cavity with an applied bias voltage based on the publication by S. Das, "Quality of a Ferroelectric Material," IEEE Trans. MTT-12, pp. 440–448, July 1964.

Das discussed operation, of microwave ferroelectric devices, slightly above the Curie temperature, to avoid hysterisis and showed the permittivity of a ferroelectric material to be maximum at the Curie temperature and the permittivity to reduce in magnitude as one moves away from the Curie temperature based on the publication by S. Das, "Quality of a Ferroelectric Material," IEEE Trans. MTT-12, pp. 440–445, July 1964.

Properties of ferroelectric devices have been discussed in the literature. R. Das, "Ferroelectric Phase Shifters," IEEE Int'l Sympopsium Digest, pp. 185–187, 1987. In 1967, this inventor stated a dielectric loss of 0.035 dB per wavelength in a typical single crystal ferroelectric material, in R. Das, "Thin Ferroelectric Phase Shifters'" Solid State Electronics, vol. 10, pp. 857–863, 1967. Ferroelectrics have been used for the time delay steering of an array. S. Das, "Ferroelectrics for time delay steering of an array," Ferroelectrics, 1973, pp. 253–257. Scanning ferroelectric apertures have been discussed. S. Das, "Scanning ferroelectric apertures," The Radio and Electronic Engineer, vol. 44, No. 5, pp. 263–268, May 1974. A high Tc superconducting ferroelectric phase shifter has been discussed. C.M. Jackson, et al, "Novel monolithic phase shifter combining ferroelectric and high temperature superconductors," Microwave and Optical Technology Letters, vol. 5, No. 14, pp. 722–726, Dec. 20, 1992. One U.S. Pat. No. 5,472,936 has been issued.

SUMMARY OF THE INVENTION

A main CPW structure is formed by depositing two parallel films of a conductor on a film of a single crystal ferroelectric material.

Cavities are formed by placing irises in a main CPW structure. These cavities are tuned to a dominant resonant frequency. By the application of a bias voltage to the main CPW structure with cavities, the permittivity of the film of the ferroelectric material, underneath the CPW structure, is changed. Thus the dominant resonant frequency of the filter is changed. By changing the level of the bias voltages, different dominant resonant frequencies of the filter are obtained. Thus a tunable band pass filter is obtained. With branch cavities on a CPW structure deposited on a ferroelectric film, a tunable band reject filter is obtained.

One objective of this invention is to obtain a dielectric loss typically of 0.035 dB per wavelength in a single crystal ferroelectric material. Examples are $Sr_{1-x}Ba_xTiO_3$, $Sr_{1-x}Pb_xTiO_3$, $KTa_{1-x}NbO_3$ where the value of x ranges between 0.005 and 0.7. Another objective is to obtain a 50 ohm main CPW structure and thus to obtain a good match to an input and an output circuit. Another object is to obtain the lowest conductive loss by using a single crystal high Tc superconducting material. Examples are YBCO and TBCCO. Another objective is to avoid hysteresis by working typically above the Curie temperature of the ferroelectric material and thus (1) to avoid two values of permittivity of a ferroelectric material for each level of a bias electric field and (2) to avoid hysteresis loss with a.c. biasing. Another object of this design is to design tunable filters to handle power levels of at least 0.5 Megawatt.

With these and other objectives in view, as well hereinafter be more particularly pointed out in detail in the appended claims, reference is now made to the following description taken in connection with accompanying diagrams.

DETAILED DESCRIPTION OF THE PREFERRED EMBODIMENTS

Figure 1:
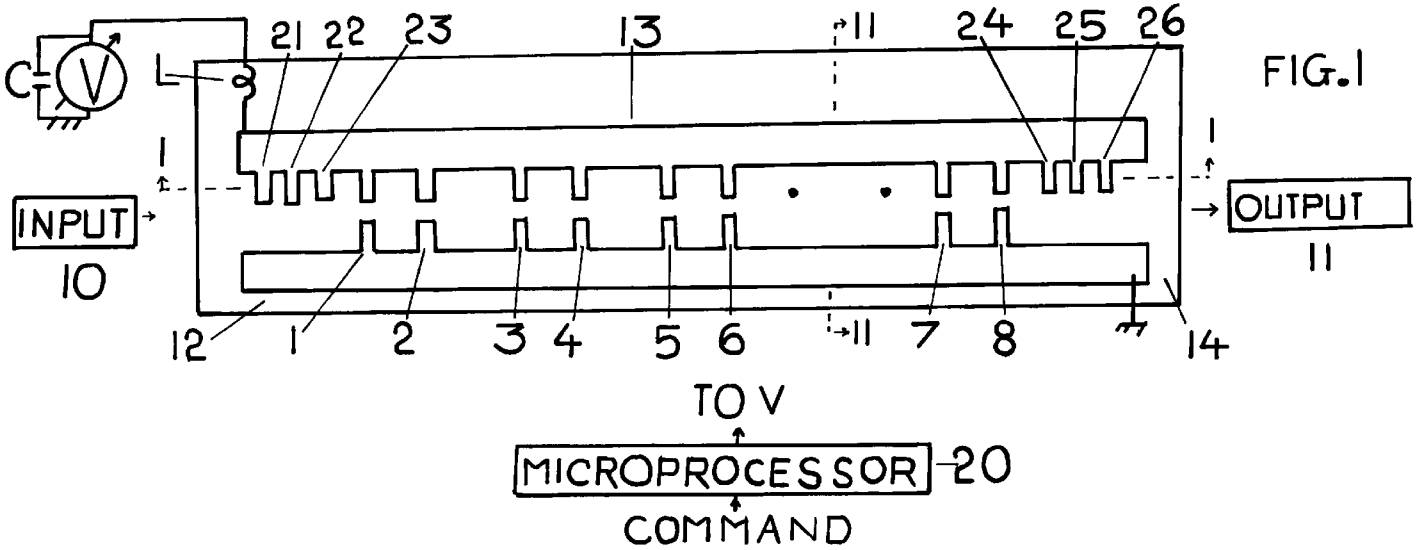
FIG. 1 depicts a top view of a CPW ferroelectric tunable band pass filter.

In FIG. 1 is depicted one embodiment of this invention, a coplanar waveguide (CPW) cavity tunable filter. The main coplanar waveguide structure is formed by two parallel films 12 and 13 of a single crystal high Tc superconducting material deposited on a film 14 of a single crystal ferroelectric crystal which has been deposited on a substrate of a single crystal dielectric solid material. Examples of such dielectric materials are sapphire and lanthanum aluminate. One purpose of a single crystal, as opposed to multicrystalline, high Tc superconductor material is to obtain a minimum conducting loss. One purpose of a single crystal, as opposed to a polycrystalline, ferroelectric material is to obtain a dielectric loss, typically, of 0.035 dB per wavelength in the ferroelectric material. One purpose of a single crystal, as opposed to a polycrystalline, dielectric material is to obtain a minimum dielectric loss. Examples of high Tc superconductor material are YBCO, TBCCO. Examples of ferroelectric materials are $Sr_{1-x}Pb_xTiO_3$ and $KTa_{1-x}Nb_xO_3$, where the value of x is between 0.005 and 0.7 so that the Curie temperature of the ferroelectric material is between, typically 72–100 degrees K, is slightly below the high superconducting temperature currently between 77–105 degrees K respectively. The purpose of working slightly above the Curie temperature is to avoid hysteresis which (1) gives two values of permittivity for each level of bias voltage and (2) produces hysteresis loss with a.c. biasing. These are applied to all embodiments of this invention.

Cavities are formed by irises placed in the interior of the CPW structure. A cavity is defined and enclosed by the irises 1 and 2. Another cavity 2 is defined and enclosed by the irises 3 and 4. Another cavity defined and enclosed by the irises 5 and 6. Another cavity is defined and enclosed by the irises 7 and 8. In practice, there are one or more cavities depending on the requirements of the filter. Another cavity is defined and enclosed by irises n and n+1. Each cavity is tuned to the dominant resonant frequency. The separation distance between the centers of the adjacent cavities is typically three quarters of a wavelength long at an operating frequency of the tunable filter, and, in another embodiment, an appropriate wavelength.

Depending on the requirements, the number of CPW cavities is selected. When the CPW cavities, of the band pass filter, are tuned to the same frequency, by keeping the distance between each pair of irises forming each cavity the same, the attenuation outside the pass band is increased compared to the attenuation that can be obtained with a single cavity. When the CPW cavities are tuned to staggered frequencies, by varying the distance between each pair of irises defining each cavity, the width of the pass band is increased compared to that of a single cavity.

CPW film 13 is connected to a variable bias source through a filter inductance L which provides a high impedance to the RF energy at the operating frequency of the filter. Any remaining RF energy after the inductance is short circuited by the filter capacitor. CPW film 12 is grounded. On the application of a bias voltage to the tunable filter, the permittivity of the ferroelectric material changes and thus the resonant frequency of the filter is changed. Application of different levels of bias voltages produces different resonant frequencies of the filter. Thus a tunable filter is obtained. The tunable filter is calibrated and a look up table is prepared with the resonant frequency versus the applied bias voltage. The level of the bias voltage is set by a microprocessor 20 on receipt of a command of a particular resonant frequency. The size of the opening of the irises controls the impedance and the high power handling capability of the filter. Input is 10 and the output is 11.

For matching the input impedance of the filter to an impedance of the input circuit, stubs 21, 22 and 23 are provided. For matching the output impedance of the filter to an impedance of the output circuit, stubs 24, 25 and 26 are provided. The number of matching stubs, the height of each matching stub and the separation distance between adjacent stubs are designed in each individual case. In another embodiment the CPW conductive depositions 12 and 13 are made of conductor which works, typically, at room temperature. Examples are copper, silver, gold, etc.

Figure 2:
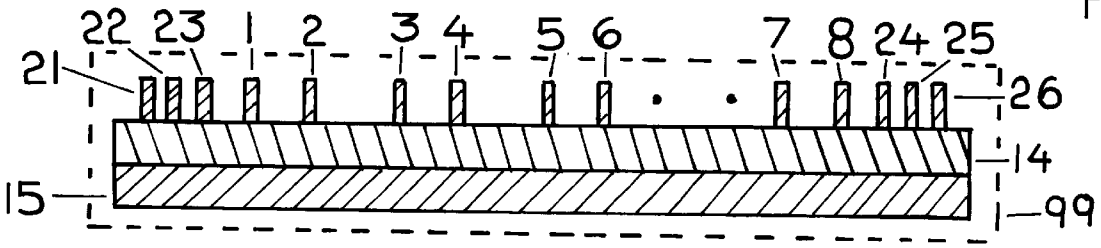
FIG. 2 depicts a longitudinal cross-section line of FIG. 1 through I—I.

FIG. 2 depicts a longitudinal cross-section line of FIG. 1 through I—I. The irises are 1, 2, 3, 4, 5, 6, 7 and 8. The matching stubs are 21, 22, 23 and 24, 25, 26. The film of a single crystal ferroelectric material is 14. A substrate of a single crystal dielectric solid material is 15. The cryocooler is 99 for keeping the tunable filter at a high superconducting temperature slightly above the Curie temperature. The part 99 becomes a means to keep the tunable filter at a constant designed temperature.

Figure 3:
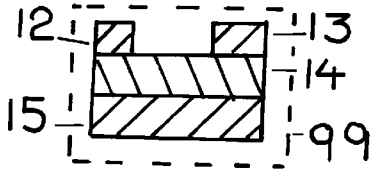
FIG. 3 depicts a transverse cross-section line of FIG. 1 through II—II.

FIG. 3 depicts a transverse cross-section line of FIG. 1 through III—III. A film of a single crystal ferroelectric is 14. A substrate of a single crystal dielectric solid material is 15. A cryocooler is 99 to keep the tunable filter at a high superconducting temperature slightly above the Curie temperature.

Figure 4:
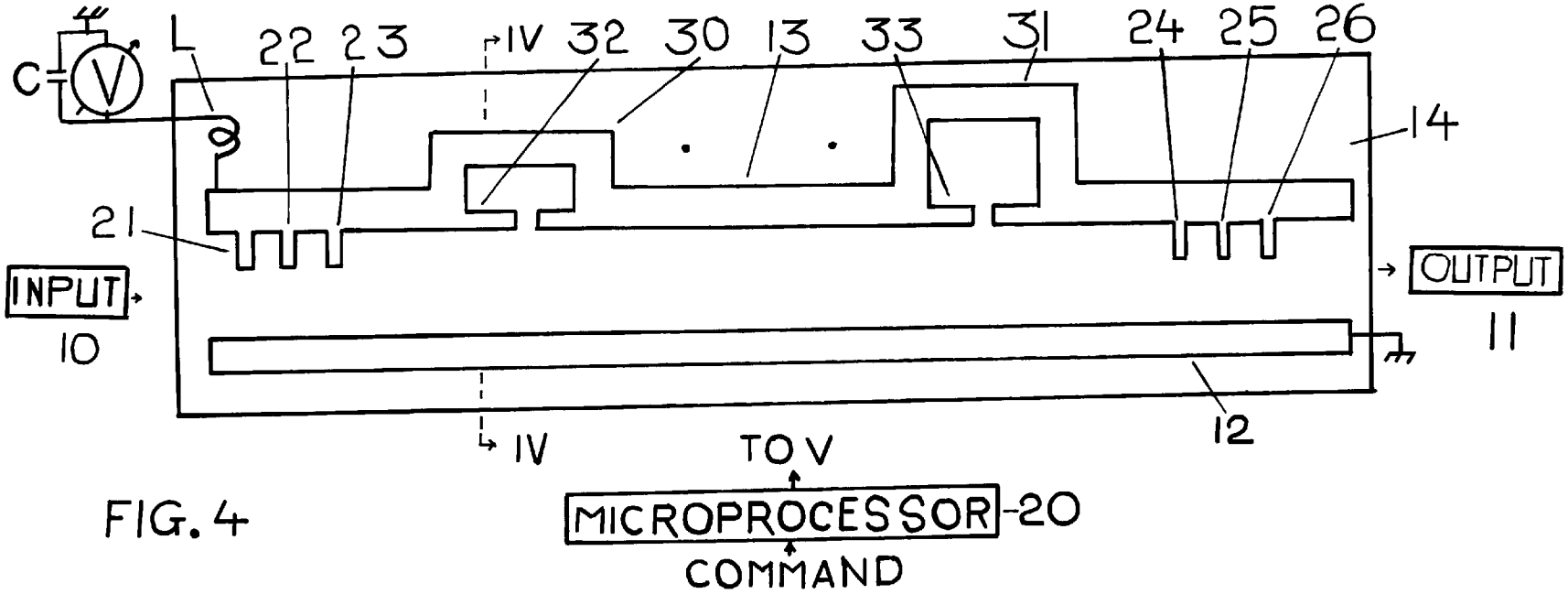
FIG. 4 depicts a top view of a CPW ferroelectric tunable band reject filter.

FIG. 4 depicts another embodiment of this invention, a ferroelectric CPW cavity tunable band reject filter. A main CPW structure is formed by films 12 and 13 of a single crystal high Tc superconductor deposited on a film 14 of a single crystal ferroelectric crystal which has been deposited on a substrate of a single crystal dielectric solid material. A branch cavity 30 is formed by a quarter wavelength long, at an operating frequency of the tunable band reject filter, branch CPW short circuited at the end. A cavity 30 is fed through an iris 32 connected at the junction of the cavity 30 and CPW film 13. A second branch cavity 31 is formed by a quarter wavelength long, at an operating frequency of the tunable band reject filter, branch CPW short circuited at the end. A cavity 31 is fed through an iris 33 connected at the junction of the cavity 31 and CPW film 13. The second cavity 31 has, typically, a different length compared to the length of the first branch cavity 30. Each cavity is tuned to the dominant resonant frequency. The dominant resonant frequency of the cavity 30, typically, is different from that of the cavity 31. Only two cavities are shown in FIG. 4. In practice, there are one or more branch cavities depending on the filter requirements.

At an off-resonant frequency, the branch cavity does not absorb any energy flowing through the main CPW structure films 12 and 13 and the input signal flows unimpeded to the output. When the input signal frequency is the same as the resonant frequency of the cavity 30 or 31, absorption of energy takes place by the branch cavity and the input signal is attenuated as it flows through to the output 11. An absorption of energy takes place at and near the dominant resonant frequency of the branch cavity 30 or 31, the absorption being maximum at the dominant resonant frequency of the branch cavity. Thus a band rejection or band elimination filter is obtained. On the application of a bias voltage to the filter, the permittivity of the ferroelectric material 14 changes, resulting in a different resonant frequency for the branch cavities 30 and 31. For different levels of bias voltages, different dominant resonant frequencies are obtained for the branch cavities 30 and 31 producing attenuation of signals of different frequencies. Thus a tunable band reject filter is obtained. Input is 10 and output is 11. If needed, for matching the input impedance of the filter to an impedance of the input circuit, stubs 21, 22 and 23 are provided. For matching the output impedance of the filter to an impedance of the output circuit, stubs 24, 25 and 26 are provided. The number of matching stubs, the height of each matching stub and the separation distance between adjacent stubs are designed in each individual case.

CPW film 13 is connected to a variable bias source through a filter inductance L which provides a high impedance to the RF energy at the operating frequency of the filter. Any remaining RF energy after the inductance is short circuited by the filter capacitor C. CPW film 12 is grounded. On the application of a bias voltage to the tunable filter, the permittivity of the ferroelectric material changes and thus the resonant frequency of the filter is changed. Application of different levels of bias voltages produces different resonant frequencies of the filter. Thus a tunable filter is obtained. The tunable filter is calibrated and a look up table is prepared with the resonant frequency versus the applied bias voltage. The level of the bias voltage is set by a microprocessor 20 on receipt of a command of a particular resonant frequency. The size of the opening of the irises controls the high power handling capability of the filter. Input is 10 and the output is 11.

Depending on the requirements, the number of CPW branch cavities is selected. When the CPW cavities, of the band reject filter, are tuned to the same frequency, by keeping the length each cavity the same, the attenuation at the reject band is increased compared to the attenuation that can be obtained with a single cavity. When the CPW cavities are tuned to staggered frequencies, by varying the length of each cavity, the width of the reject band is increased compared to that of a single cavity.

Figure 5:
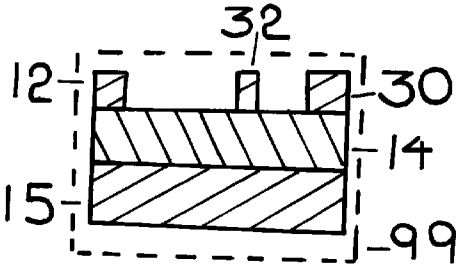
FIG. 5 depicts a transverse cross-section line of FIG. 4 through IV—IV.

FIG. 5 shows a transverse cross-section line of FIG. 4 through IV—IV. The branch cavity is 30. The main CPW structure film is 12. A film of single crystal ferroelectric material is 14. A solid substrate of a single crystal dielectric material is 15. The cryocooler is 99 for keeping the tunable filter at a high superconducting temperature slightly above the Curie temperature. In another embodiment, the CPW conductive depositions of filter are made of a conductor which works, typically, at room temperature. Examples are copper, silver, gold, etc. and 99 becomes a means to keep the tunable filter at a constant designed temperature.

Figure 6:
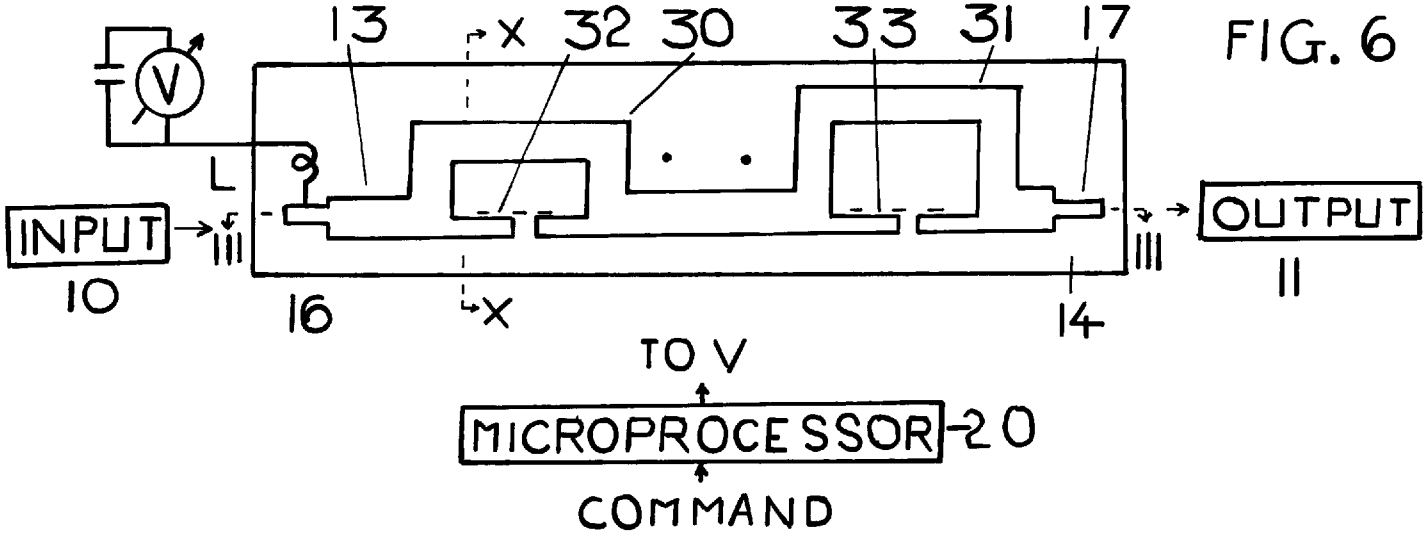
FIG. 6 depicts a top view of a microstrip ferroelectric tunable band reject filter.

FIG. 6 depicts a microstrip band reject filter. A main microstrip line is 13 formed by a deposition of a single crystal high Tc superconductor material on a film of a single crystal ferroelectric material. A branch cavity 30 is formed by a quarter wavelength long, at an operating frequency of the tunable band reject filter, branch microstrip lines short circuited at the end. A cavity 30 is fed through an iris 32 connected at the junction of the cavity 30 and main microstrip transmission line 13. A second branch cavity 31 is formed by a quarter wavelength long, at an operating frequency of the tunable reject filter, branch microstrip transmission lines short circuited at the end. A cavity 31 is fed through an iris 33 connected at the junction of the cavity 31 and main transmission line 13. The second cavity 31 has, typically, a different length compared to the length of the first branch cavity 30. Each cavity is tuned to the dominant resonant frequency. The dominant resonant frequency of the cavity 30, typically, is different from that of the cavity 31. Only two cavities are shown in FIG. 6. In practice, there are one or more branch cavities depending on the filter requirements.

At an off-resonant frequency, the branch cavity does not absorb any energy flowing through the main microstrip transmission line 13 and the input signal flows unimpeded to the output. When the input signal frequency is the same as the resonant frequency of the cavity 30 or 31, absorption of energy takes place by the branch cavity and the input signal is attenuated as it flows through to the output 11. An absorption of signal energy takes place at and near the dominant resonant frequency of the branch cavity 30 or 31, the absorption being maximum at the dominant resonant frequency of the branch cavity. Thus a band rejection or band elimination filter is obtained. On the application of a bias voltage to the filter, the permittivity of the ferroelectric material 14 changes, resulting in a different resonant frequency for the branch cavities 30 and 31. For different levels of bias voltages, different dominant resonant frequencies are obtained for the branch cavities 30 and 31 producing attenuation of signals of different frequencies. Thus a tunable band reject filter is obtained. Input is 10 and output is 11. The impedance of the microstrip line is low, of the order of 1.5 ohms. To match this microstrip line of low impedance to 50 ohm circuits, a quarter wavelength long, at an operating frequency of the filter, matching transformer is used. For matching the input impedance, typically 1.5 ohms, of the filter to the impedance, generally 50 ohms, of an input circuit of the filter, a quarter wavelength long, at an operating frequency of the filter, matching transformer 16 is used. For matching the output impedance, typically 1.5 ohms, of the filter, to the impedance, generally 50 ohms, of an output circuit of the filter, a quarter wavelength long, at an operating frequency, matching transformer 17 is used.

The main microstrip transmission line 13 is connected to a variable bias source through a filter inductance L which provides a high impedance to the RF energy at the operating frequency of the filter. Any remaining RF energy after the inductance is short circuited by the filter capacitor C. On the application of a bias voltage to the tunable filter, the permittivity of the ferroelectric material changes and thus the resonant frequency of the filter is changed. Application of different levels of bias voltages produces different resonant frequencies of the filter. Thus a tunable filter is obtained. The tunable filter is calibrated and a look up table is prepared with the resonant frequency versus the applied bias voltage. The level of the bias voltage is set by a microprocessor 20 on receipt of a command of a particular resonant frequency. The size of the opening of the irises controls the high power handling capability of the filter. Input is 10 and the output is 11.

Depending on the requirements, the number of microstrip branch cavities is selected. When the microstrip branch cavities, of the band reject filter, are tuned to the same frequency, by keeping the length of each cavity the same, the attenuation at the reject band is increased compared to the attenuation that can be obtained with a single cavity. When the microstrip branch cavities are tuned to staggered frequencies, by varying the length of each cavity, the width of the reject band is increased compared to that of a single cavity.

Figure 7:
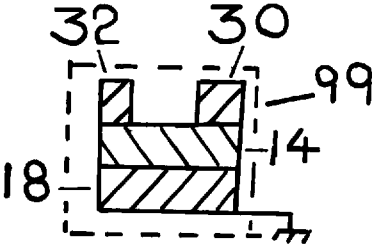
FIG. 7 depicts a transverse cross-section line of FIG. 6 through X—X.

FIG. 7 is a transverse cross-section line of FIG. 6 through X—X. The branch cavity is 30. The iris is 32. A film of a single crystal ferroelectric material, a second layer, is 14. A substrate, a first layer, of a single crystal high Tc superconductor is 18. On top of the film of a single crystal ferroelectric material is deposited films, a third layer, of a single crystal superconducting material to form the filter structure. A cryocooler is 99 which is a means for operating the filter at a high superconducting temperature slightly above the Curie temperature. In another embodiment, the conducting depositions are made of a conductor that operates typically at the room temperature. Examples are copper, silver, gold, etc. A means for operating at a constant temperature is 99.

Figure 8:
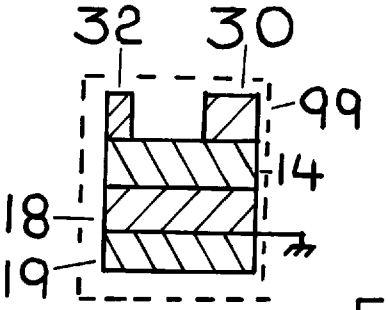
FIG. 8 depicts another transverse cross-section line of FIG. 6 through X—X.

FIG. 8 is another transverse cross-section line of FIG. 6 through X—X of another embodiment of this invention. A single crystal solid dielectric substrate, a first layer, is 19. On top of the single crystal dielectric substrate 19 is deposited a film, a second layer, 18 of a single crystal high temperature superconductor. On top of the film of a high Tc superconductor is deposited a film 14, a third layer, of a single crystal ferroelectric material. On top of the film of a single crystal ferroelectric material is deposited films, a fourth layer, of a single crystal superconducting material to form the filter structure. The branch cavity is 30 and the iris is 32.

Figure 9:
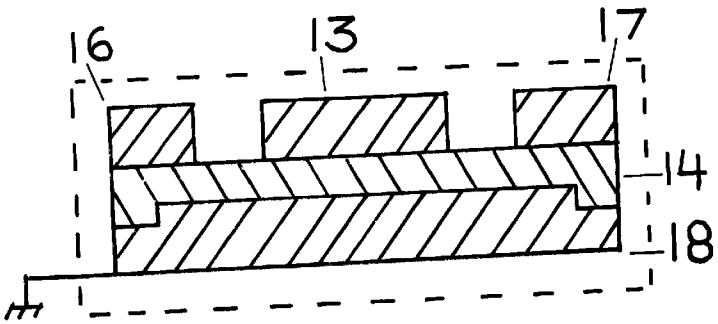
FIG. 9 depicts a longitudinal cross-section line of FIG. 6 through III—III.

FIG. 9 is a longitudinal cross-section line of FIG. 6 through X—X of another embodiment of this invention. The height of the ferroelectric material for the quarter wavelength long input and output transformers is higher than the height of the ferroelectric material for the filter. A single crystal high Tc superconductor substrate, a first layer, is 18. A film of a single crystal ferroelectric material, a second layer, is 14. The transformers are 16, 17. The microstrip is 13.

Figure 10:
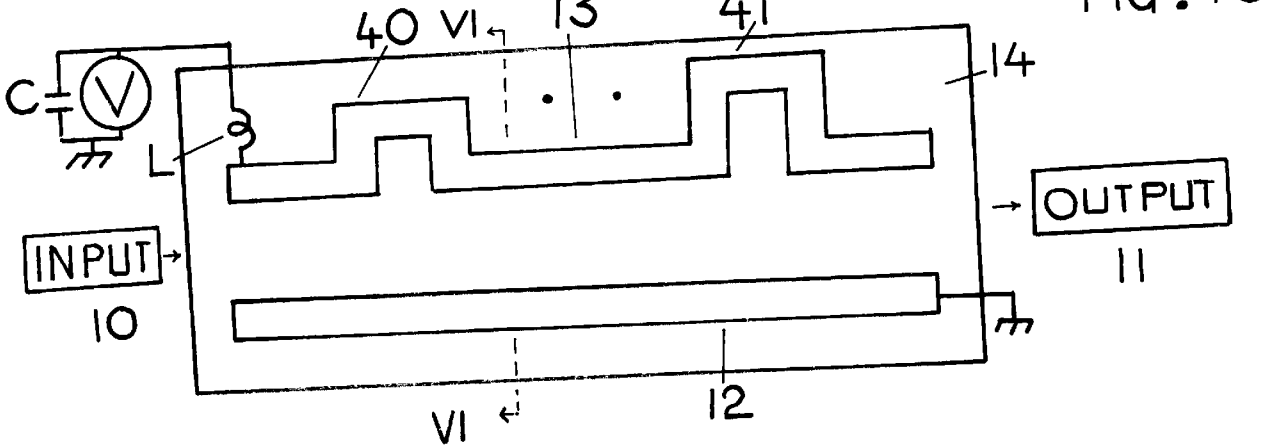
FIG. 10 depicts a top view of another CPW ferroelectric tunable band pass filter.

FIG. 10 depicts another embodiment of this invention, a CPW structure ferroelectric tunable band pass filter. A main CPW structure film is 13, the other CPW structure film being 12. Both 13 and 12 are films of a single crystal high Tc superconductor deposited on a single crystal ferroelectric film 14. A branch CPW film 40 half a wavelength, at an operating frequency of the filter, long and short circuited at the end is connected to the CPW structure film 13. At a frequency at which the branch CPW film 40 is half a wavelength long, the short circuited branch CPW film 40 presents a short circuit at the junction where the branch CPW film 40 is connected to the main CPW structure film 13. At this frequency the input signal travels unimpeded to the output. As the frequency departs from that which the branch CPW film 40 is half a wavelength long, an impedance is presented at the junction where the branch CPW film 40 connects to the main CPW structure film 13 impeding and reducing the level of input signal flowing to the output. As the frequency deviates more from that which the branch CPW film 40 is a half a wavelength long the level of the input signal is reduced more as it flows to the output. At a frequency when the branch CPW 40 is a quarter wavelength long, an infinite impedance is presented at the junction of the branch CPW film 40 and the main CPW structure film 13 providing a high attenuation as the input signal travels through to the output. Thus a band pass filter is obtained. A main CPW structure film 13 is connected through an inductance L, which produces a high impedance at an operating frequency of the filter, to a variable voltage source V which is shunted by a capacitor C. On the application of a bias voltage V to the main CPW structure film 13, the permittivity of the underlying ferroelectric material changes which changes the electrical length of the branch CPW film 40 which becomes half a wavelength long at a frequency which is different from that with no bias voltage is applied to the ferroelectric film 14. As the level of the bias voltage to the ferroelectric film is increased, the deviation, of the branch CPW film 40 from half a wavelength long at a frequency different from that when no bias voltage is applied to the ferroelectric film, is increased. Thus a tunable band pass filter is obtained. Another branch CPW film 41, which is half a wavelength long at a frequency staggered from that associated with branch CPW film 40, is connected to the main CPW structure film 13. The separation distance between the centers of branch CPW film 40 and branch CPW film 41 is typically three quarters of a wavelength long at an operating frequency of the filter. The branch CPW film 41 provides a pass band which is staggered from that associated with the branch CPW film 40. Only two branch CPW structures are shown in FIG. 10. Depending on the requirements of the filter, there are one or more branch CPW structures. The adjacent half a wavelength long branch CPW structures are of equal length when an attenuation which is greater than that can be obtained with a single CPW branch structure is required. The adjacent half a wavelength long branch CPW structures are of a staggered length when a broader pass band, than that can be obtained with a single CPW branch structure, is required. Input is 10 and the output is 11.

Figure 11:
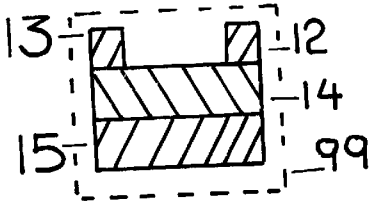
FIG. 11 depicts a transverse cross-section line of FIG. 10 through VI—VI.

FIG. 11 is a longitudinal cross-section line of FIG. 10 through VI—VI. The main CPW structure films are 13 and 12, which is the third layer. A film, a second layer, of a single crystal ferroelectric material is 14. A substrate, a first layer, of a single crystal dielectric material is 15. A cryocooler is 99, a means for operating the filter at a high superconducting temperature currently between 77 and 105 degrees K, slightly above the Curie temperature of the ferroelctric material.

Figure 12:
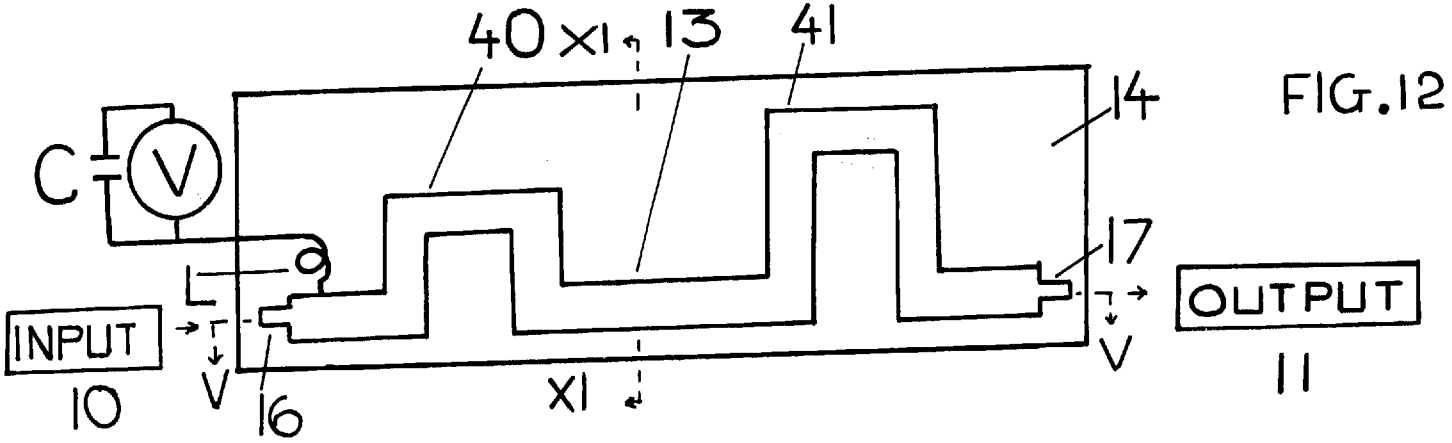
FIG. 12 depicts a top view of another embodiment of this invention: a microstrip ferroelectric tunable band pass filter.

FIG. 12 is another embodiment of this invention, a microstrip tunable band pass filter. A main microstrip line 13 is a film of a single crystal high Tc superconductor deposited on a film of a single crystal ferroelectric material 14. A branch microstrip line 40, half a wavelength long at an operating frequency of the filter and short circuited at the end, is connected to the main microstrip line 13. At a frequency at which the branch microstrip line 40 is a half a wavelength long, microstrip line 40 presents a short circuit at the junction of the branch microstrip line 40 and the main microstrip line 13. There is no attenuation of the input signal as it travels to the output. As the frequency departs from that at which the branch microstrip line 40 departs from a half wavelength long, the branch microstrip line 40 presents a finite impedance at the junction of the branch microstrip line 40 and the main microstrip line 13 attenuating the input signal as it travels to the output.

Another branch microstrip line 41, which is half a wavelength long at a frequency staggered from that associated with branch microstrip 40, is connected to the main microstrip line 13. The separation distance between the centers of branch microstrip line 40 and branch microstrip line 41 is typically three quarters of a wavelength long at an operating frequency of the filter. The branch microstrip line 41 provides a pass band which is staggered from that associated with the branch microstrip line 40. Only two branch microstrip lines are shown in FIG. 12. Depending on the requirements of the filter, there are one or more branch microstrip lines. The adjacent half a wavelength long branch microstrip lines are of equal length when an attenuation which is greater than that can be obtained with a single branch microstrip line is required. The adjacent half a wavelength long branch microstrip lines are of a staggered length when a broader pass band, than that can be obtained with a single branch microstrip line, is required. Input is 10 and the output is 11.

Figure 13:
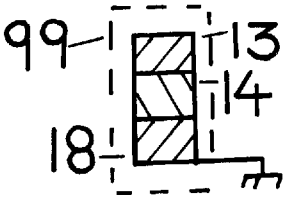
FIG. 13 depicts a transverse cross-section line of FIG. 12 through XI—XI.

FIG. 13 is a transverse cross-section line of FIG. 12 through XI—XI. The main CPW structure film is 13. A film of a single crystal ferroelectric material, a second layer, is 14. A substrate, a first layer, of a single crystal high Tc superconductor is 18. On top of the film of a single crystal ferroelectric material is deposited films, a third layer, of a single crystal superconducting material to form the filter structure. A cryocooler is 99 which is a means for operating the filter at a high superconducting temperature slightly above the Curie temperature. In another embodiment, the conducting depositions are made of a conductor that operates typically at the room temperature. Examples are copper, silver, gold, etc. A means for operating at a constant temperature is 99.

Figure 14:
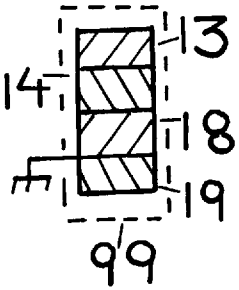
FIG. 14 depicts another transverse cross-section line of FIG. 12 through XI—XI.

FIG. 14 is another transverse cross-section line of FIG. 12 through XI—XI of another embodiment of this invention. A single crystal solid dielectric substrate, a first layer, is 19. On top of the single crystal dielectric substrate 19 is deposited a film, a second layer, 18 of a single crystal high temperature superconductor. On top of the film of a high Tc superconductor is deposited a film 14, a third layer, of a single crystal ferroelectric material. On top of the film of a single crystal ferroelectric material is deposited films, a fourth layer, of a single crystal superconducting material to form the filter structure. The main CPW structure film is 13.

FIG. 9 also depicts a longitudinal cross-section line of FIG. 12 through V—V. FIG. 9 has been recited earlier.

Figure 15:
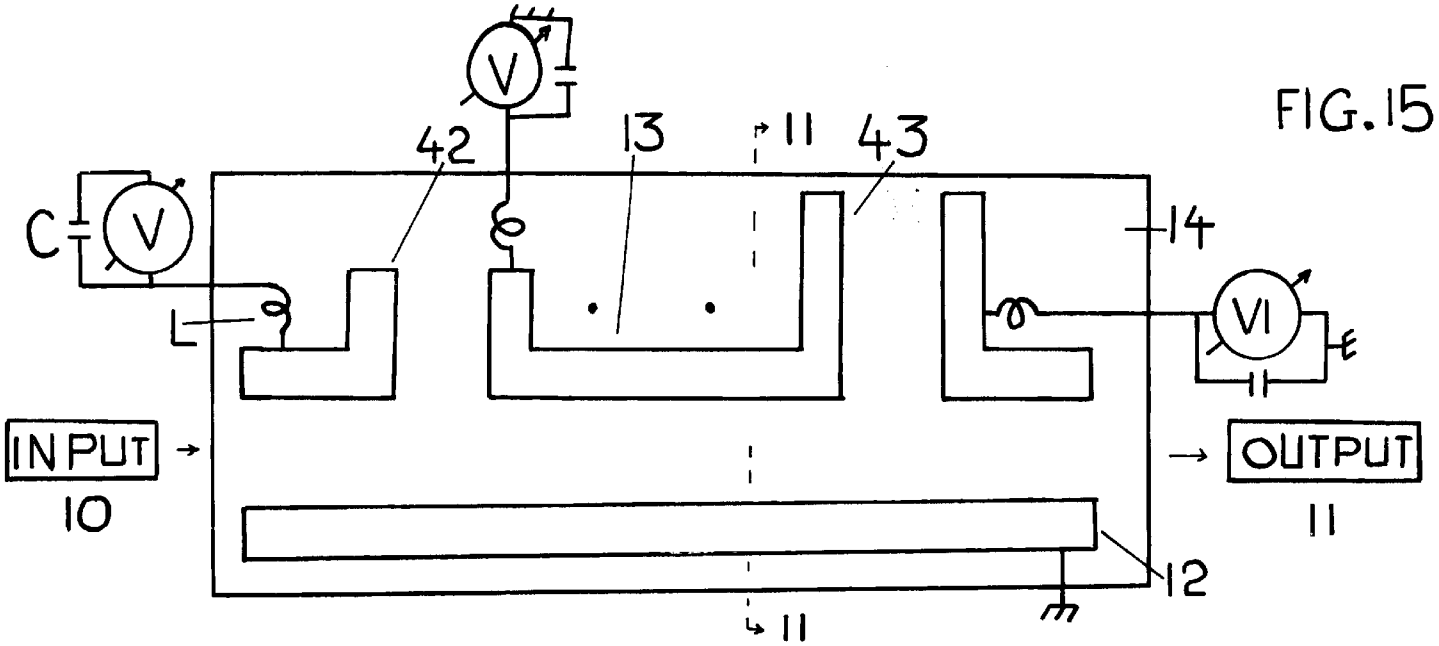
FIG. 15 depicts another embodiment of this invention: a CPW ferroelectric tunable band pass filter.

FIG. 15 depicts a top view of another embodiment of this invention a CPW band pass tunable filter. The main CPW structure contains two parallel films 13, 12 of a high Tc superconductor deposited on a film a single crystal ferroelectric film 14 which being deposited on a single crystal dielectric substrate. A quarter wavelength, at an operating frequency of the filter, long branch CPW structure is 42. The branch CPW structure film 42 is open circuited at its end. At a frequency at which the branch CPW structure film 42 is a quarter wavelength long, it presents a short circuit at the junction of the branch CPW structure film 42 and the main CPW structure film 13. The input 10 signal travels unimpeded to the output 11. At a frequency at which the branch CPW structure film 42 is no longer a quarter wavelength long, a finite impedance is introduced at the junction of the branch CPW structure film 42 and the main CPW structure film 13. The input 10 signal is 9 now attenuated as it travels to the output 11. As the signal frequency departs further from the frequency at which the branch CPW structure film 42 is a quarter wavelength long, the higher is the impedance impressed at the junction of the branch CPW film 42 and the main CPW structure film 13 introducing a higher attenuation to the input 10 signal as it travels through to the output 11. Thus a band pass filter is obtained. A second branch CPW structure is film 43 which is a quarter wavelength long at a frequency typically different from the frequency at which the branch CPW film 42 is a quarter wavelength long. Branch CPW film 43 provides a band pass filter at a frequency generally different from that at which CPW film 42 acts as a band pass filter. An application of a bias voltage V, through an inductance L and a capacitance C filter, to the branch CPW film 42 changes the permittivity of the underlying ferroelectric film 14 changing the dominant resonant frequency of the band pass filter. Application of different values of bias voltages to the branch CPW film 42 results in different dominant resonant frequencies for the band pass filter. Thus a tunable band pass filter is obtained. Application of different values of bias voltages V1 to the branch CPW film 43 results in different dominant resonant frequencies for the tunable band pass filter. Only two branch CPW structures are shown in FIG. 15. Depending on requirements, one or more branch CPW structures are used. The branch CPW structures are of the same length to produce a higher, compared to a single branch CPW structure, attenuation outside the pass band. The adjacent branch CPW structures are of different staggered lengths when a broader bandwidth band pass filter is needed. Input is 10 and the output is 11.

FIG. 3 also depicts a transverse cross-section line of FIG. 15 through II—II. FIG. 3 has been recited earlier.

Figure 16:
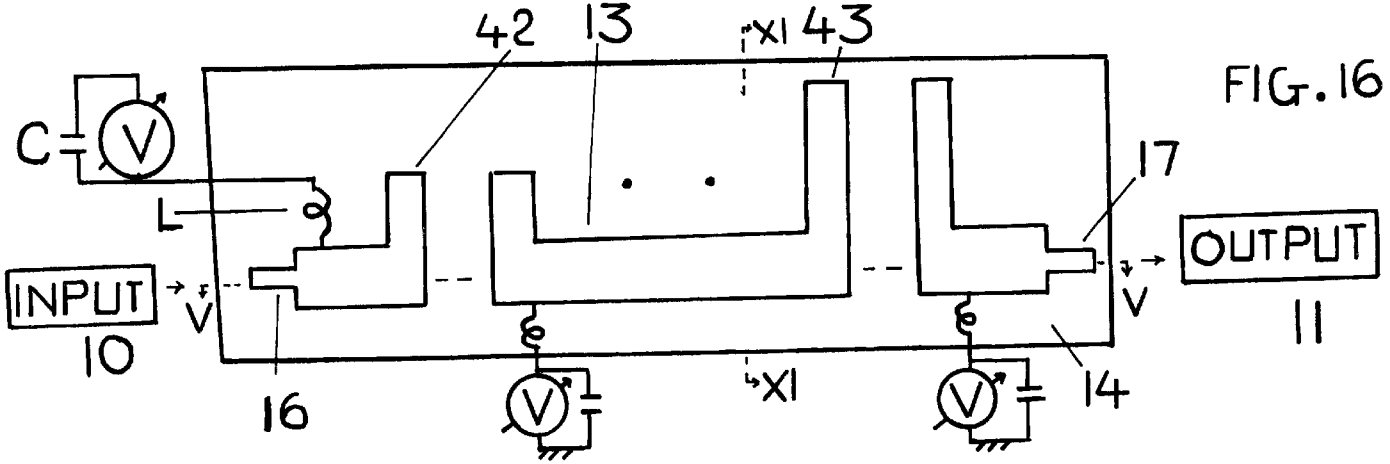
FIG. 16 depicts another embodiment of this invention: a ferroelectric tunable microstrip band pass filter.

FIG. 16 depicts a top view of another embodiment of this invention a microstrip band pass tunable filter. The main microstrip line is made of a film 13 of a high Tc superconductor deposited on a film a single crystal ferroelectric film 14 which being deposited on a single crystal conductor substrate. A quarter wavelength, at an operating frequency of the filter, long branch microstrip line is 42. The branch microstrip line 42 is open circuited at its end. At a frequency at which the branch microstrip line 42 is a quarter wavelength long, it presents a short circuit at the junction of the branch microstrip line 42 and the main microstrip line 13. The input 10 signal travels unimpeded to the output 11. At a frequency at which the branch microstrip line 42 is no longer a quarter wavelength long, a finite impedance is introduced at the junction of the branch microstrip line 42 and the main microstrip line 13. The input 10 signal is now attenuated as it travels to the output 11. As the signal frequency departs further from the frequency at which the branch microstrip line 42 is a quarter wavelength long, the higher is the impedance impressed at the junction of the branch microstrip line 42 and the main microstrip line 13 introducing a higher attenuation to the input 10 signal as it travels through to the output 11. Thus a band pass filter is obtained. A second branch microstrip line is 43 which is a quarter wavelength long at a frequency typically different from the frequency at which the branch microstrip line 42 is a quarter wavelength long. Branch microstrip line 43 provides a band pass filter at a frequency generally different from that at which branch microstrip line 42 acts as a band pass filter. An application of a bias voltage V, through an inductance L and a capacitance C filter, to the branch microstrip line 42 changes the permittivity of the underlying ferroelectric film 14 changing the dominant resonant frequency of the band pass filter. Application of different values of bias voltages to the branch microstrip line 42 results in different dominant resonant frequencies for the band pass filter. Thus a tunable band pass filter is obtained. Application of different values of bias voltages V to the branch microstrip line 43 results in different dominant resonant frequencies for the tunable band pass filter. Only two branch microstrip lines are shown in FIG. 16. Depending on requirements, one or more branch microstrip lines are used. The branch microstrip lines are of the same length to produce a higher, compared to a single branch microstrip line, attenuation outside the pass band. The adjacent branch microstrip lines are of different staggered lengths when a broader bandwidth band pass filter is needed.

FIG. 12 and FIG. 14 also depict transverse cross-section lines of FIG. 16 through XI—XI. FIG. 12 and FIG. 14 have been recited earlier.

FIG. 9 also depicts a longitudinal cross-section line of FIG. 16 through V—V. FIG. 9 has been recited earlier.

Figure 17:
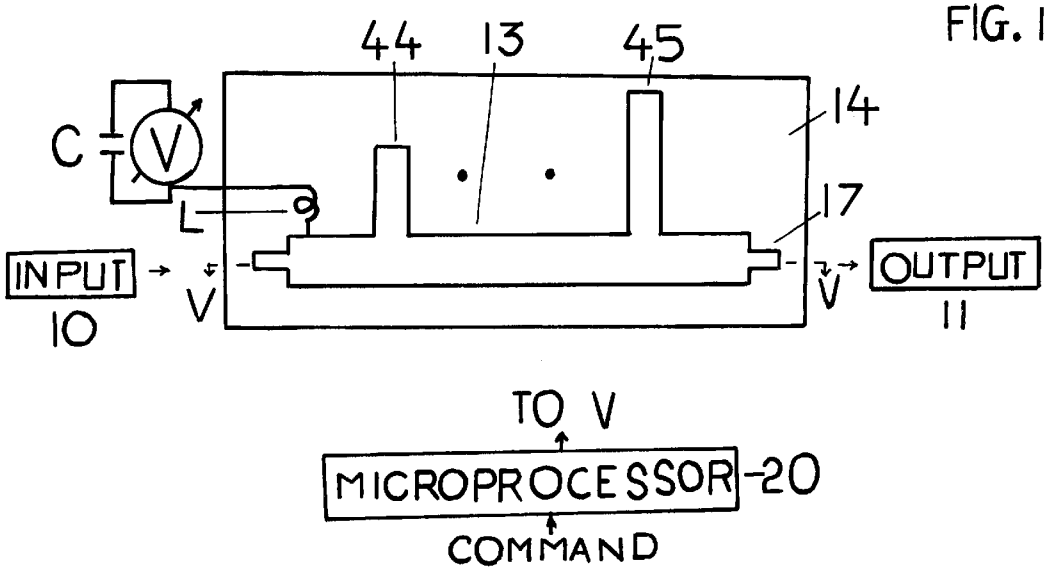
FIG. 17 is another embodiment of this invention.

FIG. 17 depicts a top view of another embodiment of this invention a microstrip band pass tunable filter. The main microstrip line is made of a film 13 of a high Tc superconductor deposited on a film of a single crystal ferroelectric film 14 which being deposited on a single crystal conductor substrate. A quarter wavelength, at an operating frequency of the filter, long branch microstrip line is 44. The branch microstrip line 44 is open circuited at its end. At a frequency at which the branch microstrip line 44 is a quarter wavelength long, it presents a short circuit at the junction of the branch microstrip line 44 and the main microstrip line 13. The input 10 signal travels unimpeded to the output 11. At a frequency at which the branch microstrip line 44 is no longer a quarter wavelength long, a finite impedance is introduced at the junction of the branch microstrip line 44 and the main microstrip line 13. The input 10 signal is now attenuated as it travels to the output 11. As the signal frequency departs further from the frequency at which the branch microstrip line 44 is a quarter wavelength long, the higher is the impedance impressed at the junction of the branch microstrip line 44 and the main microstrip line 13 introducing a higher attenuation to the input 10 signal as it travels through to the output 11. Thus a band pass filter is obtained. A second branch microstrip line is 45 which is a quarter wavelength long at a frequency typically different from the frequency at which the branch microstrip line 44 is a quarter wavelength long. Branch microstrip line 45 provides a band pass filter at a frequency generally different from that at which branch microstrip line 42 acts as a band pass filter. An application of a bias voltage V, through an inductance L and a capacitance C filter, to the branch microstrip line 44 changes the permittivity of the underlying ferroelectric film 14 changing the dominant resonant frequency of the band pass filter. Application of different values of bias voltages to the branch microstrip line 44 results in different dominant resonant frequencies for the band pass filter. Thus a tunable band pass filter is obtained. Application of different values of bias voltages V to the branch microstrip line 45 results in different dominant resonant frequencies for the tunable band pass filter. Only two branch microstrip lines are shown in FIG. 17. Depending on requirements, one or more branch microstrip lines are used. The branch microstrip lines are of the same length to produce a higher, compared to a single branch microstrip line, attenuation outside the pass band. The adjacent branch microstrip lines are of different staggered lengths when a broader bandwidth band pass filter is needed. The tunable filter is calibrated and a look up table is prepared with the resonant frequency versus the applied bias voltage. The level of the bias voltage is set by a microprocessor 20 on receipt of a command of a particular resonant frequency.

Figure 18:
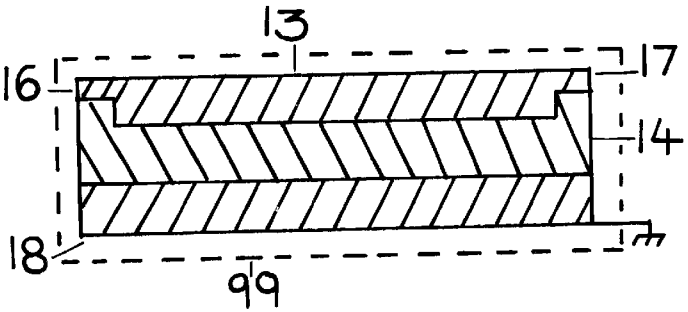
FIG. 18 is a longitudinal cross-section line of FIG. 17 through V—V.

FIG. 18 is a longitudinal cross-section line of FIG. 17 through V—V of another embodiment of this invention. The height of the ferroelectric material for the quarter wavelength long input and output transformers is higher than the height of the ferroelectric material for the filter. A single crystal high Tc superconductor substrate, a first layer, is 18. A film of a single crystal ferroelectric material, a second layer, is 14. The main microstrip line 13, the quarter wavelength input and output transformers 16 and 17 are part of the first layer.

It should be understood that the foregoing discussions relate to only typical embodiments of the invention and that numerous modifications or alternatives may be made therein, by those of ordinary skill, without departing from the spirit and scope of the invention as set forth in the appended claims. Different frequencies types of coplanar waveguides, all ferroelectric materials, compositions of ferroelectric materials with powder polythene and other low permittivity materials, ferroelectric liquid crystals (FLC), cavities, irises, stubs and high Tc superconductors are contemplated in this invention. A CPW structure provides a broad bandwidth.

What is claimed is:

1. A tunable band pass filter having a single crystal ferroelectric material having a permittivity which is voltage dependent, a single crystal dielectric material, a dominant resonant frequency, an operating frequency, an input, an output, high Tc superconductor and comprising:

a first layer of said single crystal dielectric material forming a substrate;

a second layer of a film of said single crystal ferroelectric material, having said permittivity, deposited on said single crystal dielectric material of said first layer;

dielectric loss of said single crystal ferroelectric material being typically 0.035 dB per wavelength in the ferroelectric material;

a third layer of two parallel films of a conductor deposited on said single crystal ferroelectric film of said second layer and forming a main CPW structure;

first through nth irises;

first through nth cavities;

a first pair of said irises, comprised of films of a conductor and being connected to said main CPW structure defining and enclosing said first cavity;

said first cavity being tuned to said dominant resonant frequency; first through nth input stubs;

a second pair of said irises comprised of a film of a conductor deposited on said film of said single crystal ferroelectric and being connected to said main CPW structure defining and enclosing said second cavity;

said second cavity being tuned to said dominant resonant frequency;

centers of said first cavity and said second cavity being separated by a distance of typically three quarters of a wavelength long, at said operating frequency of the filter;

third through nth pair of said irises comprised of films of a conductor defining and enclosing said third through nth cavities respectively;

centers of said second through (n−1)th cavities and centers of said adjacent third through nth cavities respectively being separated by a distance of typically three quarters of a wavelength long, at said operating frequency of the filter;

for matching an impedance of a input circuit of the filter to an impedance of said input of the filter, said input first, second, third stubs being connected to said main CPW structure at locations between said input and said first iris;

first through nth output stubs;

for matching an impedance of an output circuit of the filter to an impedance of said output of the filter, said output first, second third stubs being connected to said main CPW structure at locations between said output and said nth iris;

said conductive films of said main CPW structure, said irises, said matching stubs are comprised of a single crystal high Tc superconductor;

said film of said single crystal high Tc superconductor providing a minimum conductive loss;

means, attached to said filter, for applying an bias voltage to said filter;

a microprocessor for controlling the level of said bias voltage and thus said operating frequency of said tunable filter;

said filter having a capability to handle a 0.5 MW level of RF power; and said tunable filter being operated at a high superconducting temperature slightly above the Curie temperature of said ferroelectric material.

2. A tunable band pass filter of claim 1:

wherein all said cavities being tuned to identically the same dominant resonant frequency; and said single crystal ferroelectric material being $Sr_{1-x}Ba_xTiO_3$ and the value of x is between 0.005 and 0.7.

3. A tunable band pass filter of claim 1:

wherein said adjacent cavities being tuned to a staggered dominant resonant frequency; and said single crystal ferroelectric material being $Sr_{1-x}Ba_xTiO_3$ and the value of x is between 0.005 and 0.7.

4. A tunable band pass filter of claim 1:

wherein said high Tc superconductor being YBCO.

5. A tunable band pass filter of claim 1:

wherein said high Tc superconductor being TBCCO.

6. A tunable band pass filter of claim 5:

wherein said single crystal ferroelectric material being $Sr_{1-x}Pb_xTiO_3$ and the value of x is between 0.005 and 0.7.

7. A ferroelectric tunable band reject CPW filter having a single crystal ferroelectric material having a permittivity which is voltage dependent, a single crystal dielectric material, an operating frequency, an input, an output, a Curie temperature and comprising:

a first layer of said single crystal dielectric material forming a substrate;

a second layer of a film of said single crystal ferroelectric material, having said permittivity, deposited on said single crystal dielectric material of said first layer;

dielectric loss of said single crystal ferroelectric material being typically 0.035 dB per wavelength in the ferroelectric material;

a third layer of two parallel films of a conductor deposited on said single crystal ferroelectric film of said second layer and forming a main CPW structure;

first through nth said irises;

first through nth branch CPW lines; first through nth cavities;

said first branch CPW line, the ends thereof being short circuited being connected to said main CPW structure through said first iris and defining said first cavity;

said first cavity being tuned to said first dominant resonant frequency; first through nth input said stubs;

for matching an impedance of an input circuit of the tunable band reject filter to an impedance of the tunable filter, said first, second—nth input matching stubs being connected respectively to said main CPW structure at locations between said input of the filter and said first iris;

said second branch CPW line, the ends thereof being short circuited, being connected to said main CPW structure through a second iris defining said second cavity;

said second cavity being tuned to a second dominant resonant frequency;

centers of said first cavity and said second cavity being separated by a distance of typically three quarters of a wavelength long at said operating frequency of the filter;

said third through nth branch CPW lines, the ends thereof of each being short circuited, being connected to said main CPW structure through said third through nth irises respectively and defining said third through nth cavities respectively;

said third through nth cavities being tuned to third through nth staggered dominant resonant frequencies respectively;

said first through nth branch CPW lines and said first through nth irises comprised of films of a conductor deposited on said film of said single crystal ferroelectric material of said second layer;

separation distance between centers of adjacent said second through nth cavities being respectively three quarters of a wavelength long at said operating frequency of said tunable filter;

first through nth output stubs;

for matching the impedance of an output circuit of the filter to an impedance of said output of the filter, said output first, second—nth stubs being connected respectively to said main CPW structure at locations between said output of the filter and said nth iris;

said conductive films of said main CPW structure, branch CPW lines, said irises and said matching input and output stubs being comprised of a single crystal high Tc superconductor;

said film of said single crystal high Tc superconductor providing a minimum conductive loss;

means, attached to said filter, for applying a bias voltage to said filter;

a microprocessor for controlling the level of said bias voltage and thus said operating frequency of said tunable filter;

said tunable filter having a capability to handle a 0.5 MW level of RF power;

said tunable filter being operated at a high superconducting temperature above the Curie temperature of said single crystal ferroelectric material to avoid hysteresis.

8. A tunable band pass filter of claim 7:

wherein said high Tc superconductor being YBCO.

9. A tunable band pass filter of claim 7:

wherein said high Tc superconductor being TBCCO.

10. A tunable band pass filter of claim 9:

wherein said single crystal ferroelectric material being $Sr_{1-x}Pb_xTiO_3$ and the value of x is between 0.005 and 0.7.

11. A tunable band pass filter of claim 7:

wherein said single crystal ferroelectric material being $Sr_{1-x}Ba_xTiO_3$ and the value of x is between 0.005 and 0.7 and said said high Tc superconductor being YBCO.

12. A tunable band pass filter of claim 7:

wherein said single crystal ferroelectric material being $Sr_{1-x}Ba_xTiO_3$ and the value of x is between 0.005 and 0.7.

13. A ferroelectric tunable band pass CPW filter having a single crystal ferroelectric material having a permittivity which is voltage dependent, a single crystal dielectric material, having an operating frequency, an input, an output, conductor, high Tc superconductor, a Curie temperature and comprising:

a first layer of said single crystal dielectric material forming a substrate;

a second layer of a film of said single crystal ferroelectric material, having said permittivity, deposited on said single crystal dielectric material of said first layer;

dielectric loss of said single crystal ferroelectric material being typically 0.035 dB per wavelength in the ferroelectric material;

a third layer of two parallel films of a conductor deposited on said single crystal ferroelectric film of said second layer and forming a main CPW structure;

first through nth branch CPW lines;

said first branch CPW line, the ends thereof being short circuited, being connected to said main CPW structure, the length of said branch line being a half a wavelength long at said operating frequency of the tunable filter;

said second branch CPW line, the ends thereof being short circuited, being connected to said main CPW structure, the length of said branch line being a half a wavelength long at said operating frequency of the tunable filter;

centers of said first branch line and said second branch line being separated by a distance of typically three quarters of a wavelength long at said operating frequency of the tunable filter;

said third through nth branch CPW lines, the ends thereof of each being short circuited, being connected to said main CPW structure, the length of each said branch line being a half a wavelength long at said operating frequency of the tunable filter respectively;

said first through nth branch CPW lines comprised of films of a conductor deposited on said film of said single crystal ferroelectric material of said second layer;

separation distance between centers of adjacent said second through nth branch lines being respectively three quarters of a wavelength long at said operating frequency of said tunable filter;

said conductive films of said main CPW structure, branch CPW lines being comprised of a single crystal high Tc superconductor;

said film of said single crystal high Tc superconductor providing a minimum conductive loss;

means, attached to said filter, for applying a bias voltage to said filter;

a microprocessor for controlling the level of said bias voltage and thus said operating frequency of said tunable filter;

said tunable filter having a capability to handle a 0.5 MW level of RF power;

said tunable filter being operated at a high superconducting temperature above the Curie temperature of said single crystal ferroelectric material to avoid hysteresis.

14. A tunable band pass filter of claim 13:

wherein said high Tc superconductor being YBCO.

15. A tunable band pass filter of claim 13:

wherein said high Tc superconductor being TBCCO.

16. A tunable band pass filter of claim 13:

wherein said single crystal ferroelectric material being $Sr_{1-x}Pb_xTiO_3$ and the value of x is between 0.005 and 0.7.

17. A tunable band pass filter of claim 13:

wherein all said branch lines being half a wavelength long at said operating frequency of the tunable filter; and said single crystal ferroelectric material being $Sr_{1-x}Ba_xTiO_3$ and the value of x is between 0.005 and 0.7.

18. A ferroelectric tunable band pass CPW filter having a single crystal ferroelectric material having a permittivity which is voltage dependent, a single crystal dielectric material, having an operating frequency, an input, an output, conductor, high To superconductor, a Curie temperature and comprising:

a first layer of said single crystal dielectric material forming a substrate;

a second layer of a film of said single crystal ferroelectric material, having said permittivity, deposited on said single crystal dielectric material of said first layer;

dielectric loss of said single crystal ferroelectric material being typically 0.035 dB per wavelength in the ferroelectric material;

a third layer of two parallel films of a conductor deposited on said single crystal ferroelectric film of said second layer and forming a main CPW structure;

first through nth branch CPW lines;

said first branch CPW line, the ends thereof being open circuited, being connected to said main CPW structure, the length of said branch line being a quarter of a wavelength long at said operating frequency of the tunable filter;

said second branch CPW line, the ends thereof being open circuited, being connected to said main CPW structure, the length of said branch line being a quarter of a wavelength long at said operating frequency of the tunable filter;

centers of said first branch line and said second branch line being separated by a distance of typically three quarters of a wavelength long at said operating frequency of the tunable filter;

said third through nth branch CPW lines, the ends thereof of each being open circuited, being connected to said main CPW structure, the lengths of each said branch line being a quarter of a wavelength long at said operating frequency of the tunable filter respectively;

said first through nth branch CPW lines comprised of films of a conductor deposited on said film of said single crystal ferroelectric material of said second layer;

separation distance between centers of adjacent said second through nth branch lines being respectively three quarters of a wavelength long at said operating frequency of said tunable filter;

said conductive films of said main CPW structure, branch CPW lines being comprised of a single crystal high Tc superconductor;

said film of said single crystal high Tc superconductor providing a minimum conductive loss;

means, attached to said filter, for independently applying a bias voltage to each said branch lines of the tunable filter;

a microprocessor for controlling the level of independent bias voltages and thus said operating frequency of said tunable filter;

said tunable filter having a capability to handle a 0.5 MW level of RF power;

said tunable filter being operated at a high superconducting temperature above the Curie temperature of said single crystal ferroelectric material to avoid hysteresis.

19. A tunable band pass filter of claim 18:

wherein said high Tc superconductor being YBCO; and said single crystal ferroelectric material being $Sr_{1-x}Ba_xTiO_3$ and the value of x is between 0.005 and 0.7.

20. A tunable band pass filter of claim 18:

wherein said high Tc superconductor being TBCCO; and said single crystal ferroelectric material being $Sr_{1-x}Pb_xTiO_3$ and the value of x is between 0.005 and 0.7.

* * * * *